US005934663A

United States Patent [19]

Saito et al.

[11] Patent Number: 5,934,663

[45] **Date of Patent: *Aug. 10, 1999**

[54] RUBBER ROLLERS FOR CARRYING MEDIA, AND EVALUATION OF THEIR ABRASION

[75] Inventors: Kazumasa Saito; Takao Shinohara; Tsutomu Iikawa, all of Kawasaki, Japan

[73] Assignee: Fujitsu Limited, Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/365,928

[22] Filed: Dec. 29, 1994

[30] Foreign Application Priority Data

Mar. 4, 1994 [JP] Japan ..... 6-034942

[51] Int. Cl.[6] ..... B65H 3/06

[52] U.S. Cl. ..... 271/109; 271/314; 492/59; 198/780

[58] Field of Search ..... 271/109, 314, 271/272; 492/53, 56, 59; 198/780; 428/35.7, 36.8

[56] References Cited

U.S. PATENT DOCUMENTS

| | | | |
|---|---|---|---|
| 4,164,491 | 8/1979 | Itoh et al. | 260/375 SB |
| 4,287,649 | 9/1981 | Kohler | 29/130 |
| 4,545,544 | 10/1985 | Rockerath et al. . | |
| 4,748,910 | 6/1988 | Richter . | |
| 4,756,065 | 7/1988 | Carlson | 492/56 |
| 5,120,609 | 6/1992 | Blaszak et al. | 428/446 |
| 5,142,759 | 9/1992 | Bonander et al. . | |
| 5,383,656 | 1/1995 | Mendel et al. | 271/258 |
| 5,468,531 | 11/1995 | Kikukowa et al. | 272/56 |
| 5,485,991 | 1/1996 | Hirano et al. | 271/121 |
| 5,605,657 | 2/1997 | Nybakken et al. | 264/102 |

FOREIGN PATENT DOCUMENTS

| | | | |
|---|---|---|---|
| 0 036 987 A1 | 10/1981 | European Pat. Off. . | |
| 48910 | 10/1989 | Japan | 271/109 |
| 403243552 | 10/1991 | Japan | 271/272 |
| 404358644 | 12/1992 | Japan | 271/272 |
| 405024675 | 2/1993 | Japan | 271/109 |
| 5-125210 | 5/1993 | Japan . | |
| 2 133 391 | 7/1984 | United Kingdom . | |
| 2 250 272 | 6/1992 | United Kingdom . | |
| 2 260 987 | 5/1993 | United Kingdom . | |

*Primary Examiner*—H. Grant Skaggs
*Attorney, Agent, or Firm*—Armstrong, Westerman, Hattori, McLeland & Naughton

[57] ABSTRACT

Rubber rollers for carrying media, comprising a blend of urethane rubber and silicone rubber, and an apparatus equipped therewith. A rubber roller abrasion evaluating tester provided with means for carrying a medium to be carried while in contact with rubber rollers to be evaluated, and means for forcefully causing slippage of the carried medium by a prescribed distance on the rollers. A method of selecting a medium to be carried which has a prescribed abrasive strength, by abrading a carried medium under a constant weight using an abrading material and calculating the rate of the abrasion of the carried medium.

5 Claims, 2 Drawing Sheets

RUBBER ROLLERS FOR CARRYING MEDIA, AND EVALUATION OF THEIR ABRASION

BACKGROUND OF THE INVENTION

1. Field of the Invention

The present invention relates to rubber rollers for carrying media. More specifically, it relates to rubber rollers for carrying media, which have a high starting friction coefficient and a low degree of abrasion with little change in the friction coefficient even upon long-term use, as well as to an apparatus equipped therewith. The present invention also relates to an abrasion evaluation tester capable of evaluating the progress of abrasion without actually using the apparatus equipped with the rubber rollers. The present invention further relates to a method of selecting media with abrasion characteristics close to those of the actual medium to be carried.

2. Description of the Related Art

Rubber rollers are commonly used as means for carrying media such as normal copying paper and ink ribbons, printed pages, receipts, and the like. The characteristics required of rubber rollers for carrying such media are a high starting friction coefficient and little change in the friction coefficient even upon long-term use. These carrying properties are impaired when paper dust and dirt attach to the surface of the rubber rollers thus lowering the friction coefficient between the rubber rollers and the carried medium, or when ink on the surface of the carried medium attaches to the surface of the rubber rollers, thus lowering the friction coefficient and causing the carried medium to slip. Another cause is that as the rubber rollers are used, abrasion of the rubber leads to contour deformities, or the influence of the surrounding temperature and humidity, or oxygen and ozone causes the surface of the rubber rollers to become viscous, creating cracks and often making it impossible to carry the medium.

With recent information-related devices, more and more printing systems perform printing at a prescribed location, as in the case of printing on grid document sheets, printing on ruled line document sheets, printing on postcards, printing on bank deposit books, etc. In addition, laser printers connected to computer terminals require high-speed paper carrying and double-sided printing, while greater speeds for ejecting receipts of automatic cash dispensers at banks are also coming into demand. Abrasion resistant rubber is also desired for automatic ticket gate machines at train stations. Thus, rubber rollers with a rubber hardness of 60° or less according to JIS-A are widely used to meet the demands of precise transport distance and speedy transport. As a result, replacement of the rubber rollers over smaller intervals of time becomes unavoidable because of their lower abrasion resistance and deformities in their dimensions with use. Abrasion is particularly considerable when employing carrying mechanisms which cause forced slipping between the rubber rollers and carried medium.

Materials widely used in rubber rollers for carrying media have conventionally included natural rubber, butadiene rubber, chloroprene rubber, urethane rubber, nitrile rubber, ethylene/propylene rubber, and the like, while silicone rubber and fluorine rubber are used in sections which require heat resistance. Most of these, with the exception of urethane rubber, have inferior abrasion resistance, and thus cannot withstand extended use especially in the case of mechanisms which carry media while forcefully causing slipping between the rubber rollers and the media, resulting in greater abrasion and shape deformity. Also, though urethane rubber has excellent abrasion resistance, paper powder from the medium and printing ink tend to attach to the surface of rubber rollers made therefrom resulting in a lower friction coefficient, and therefore slipping occurs with the carried medium and makes it impossible to perform the specified amount of carrying, or in the worst case causes total slippage and halts the carrying altogether. Thus, there presently do not exist rubber rollers capable of maintaining their original characteristics over long periods of use, and consequently rubber rollers must be periodically replaced.

A major reason complicating the development of rubber rollers whose carrying properties do not change over long periods of time is the fact that no convenient and suitable testers exist for the development of rubber rollers. Consequently, since most evaluations are performed with testers made to product specifications (hereunder, "actual device"), and long periods of time are required to evaluate whether the rubber rollers are able to withstand extended use, the types and numbers of rubber rollers which may be tested are limited. Furthermore, in tests which employ the actual devices, the unique characteristics of the actual devices themselves are exhibited, thus interfering with an objective evaluation. Consequently, there is need for the development of a tester with a carrying mechanism similar to that of the actual device, but which is capable of reproducing the same results of extended use of the actual device, and in a shorter period of time. Such an evaluating tester does not presently exist.

In addition, for the evaluation of the abrasiveness and change in the friction coefficient of rubber rollers which occur with the carrying of paper medium and the like, the evaluation tester must operate with the same carrying mechanism as the actual device, but it must also carry the same medium as the actual device. However, there are some cases in which the evaluating tester cannot carry the same paper as the paper used by the actual device. In such cases, it is necessary to select a medium which has a paper quality close to that of the paper medium and which is capable of being carried by the evaluating tester. The effect of the actual medium on the rubber roller is largely determined by the size of the friction coefficient and abrasive properties of the medium. Consequently, other types of carried medium may be used so long as the size of their friction coefficients and their abrasive properties are the same as those of the actual medium. Measuring devices employing strain gauges for the measurement of the sizes of friction coefficients are commercially available as products, but no methods are known for the evaluation of abrasive properties.

SUMMARY OF THE INVENTION

The present invention is aimed at providing rubber rollers which, even upon extended use, are resistant to abrasion, whose friction coefficients do not vary, and which have excellent carrying characteristics, as well as devices equipped with such rubber rollers. It is also aimed at providing an abrasion evaluating tester capable of evaluating the state of rubber rollers in an actual device in a short period of time without using the actual device, as well as a method of finding a medium to be carried which has qualities close to those of the actual carried medium, to be used in the evaluating tester.

In order to achieve the above-mentioned objects, the present invention provides rubber rollers for carrying media, which comprise a blend of urethane rubber and silicone rubber.

The present invention also provides devices equipped with medium-carrying means including rubber rollers, wherein the rubber rollers comprise a blend of urethane rubber and silicone rubber.

The devices include information-related devices, automatic cash dispensers and automatic ticket dispensers and ticket gate machines.

A rubber roller according to the present invention is prepared by a method which includes mixing a liquid urethane rubber prepolymer and a liquid silicone rubber prepolymer, and injecting the mixture into a mold for hardening.

The present invention also provides a rubber roller abrasion evaluating tester for evaluating the abrasiveness of rubber rollers for carrying media, which is equipped with means for carrying a medium to be carried while in contact with the rubber rollers to be evaluated, and means for forcefully causing slippage of the carried medium by a prescribed distance on the rollers.

The present invention further provides a method of selecting a medium to be carried, which comprises abrading a carried medium under a constant weight using an abrading material, and calculating the rate of the resulting abrasion of the carried medium, to select a medium to be carried which has the prescribed abrasive strength.

DESCRIPTION OF THE PREFERRED EMBODIMENTS

Figure 1:
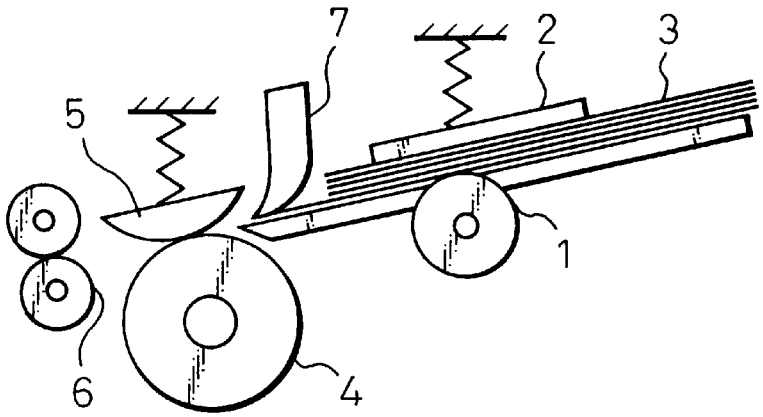
FIG. 1 is a sketch of a construction of an automatic cash dispenser which may employ rubber rollers according to the present invention.

In the course of perfecting the rubber rollers for carrying media according to the present invention, the inventors first centered their attention on the excellent abrasion resistance of urethane rubber. In addition, it was found that, although silicone rubber is considered to have a small friction coefficient in comparison with other types of rubber, the friction coefficient is not necessarily smaller than that of other types of rubber if it is obtained using liquid silicone and if the post-curing rubber hardness is 60° or less according to JIS-A, and also that in such a case the friction coefficient does not vary even after many sheets of different types of media are carried, or even when ink used in ink ribbons attaches to the surface of the silicon rubber. Nevertheless, it became clear that silicone rubber has about the same abrasiveness as common types of rubber other than urethane rubber. Therefore, a rubber roller made of a blend of urethane rubber and silicon rubber was prepared and evaluated using a newly developed rubber roller evaluating tester according to the present invention, to achieve the completion of a rubber roller with excellent abrasion resistance and low variance in the friction coefficient.

The urethane rubber to be used according to the present invention may be any ester-type, ether-type, caprolactone-type or other type of urethane rubber. These may generally be obtained by hardening a commercially available prepolymer with an appropriate curing agent. Also the silicone rubber used may be either a one-component curing type or a two-component curing type, but only liquid types, and not millable types, can be used. This is because the urethane rubber, being liquid, cannot mix uniformly with millable silicone rubber. In addition, since during the formation of the rubber roller the urethane/silicone blend prepolymer is poured into a metal mold at 40–90° C. for molding, silicone rubber which hardens immediately (within about 2 to 3 hours or less) at room temperature (25° C.) is unsuitable. Moreover, it is preferable to use addition rubber rather than condensation rubber in order to prevent residue of air bubbles in casted rubber rollers.

The blending ratio of the urethane rubber and silicone rubber is preferably in the range of 5–70 wt % in terms of silicone rubber content. In cases where the silicone rubber content exceeds 70 wt %, the resulting rubber roller has the same characteristics as silicone rubber, i.e. proneness to abrasion, while a content of less than 5 wt % results in the same disadvantages as urethane rubber, i.e. lowering of the friction coefficient by attachment of paper powder and ink. From the standpoint of abrasion resistance and low variance in the friction coefficient, the silicone rubber content is even more preferably in the range of 10–50 wt %. The rubber hardness of the urethane/silicone rubber blend is determined depending on the mechanism design value and the precision of the carrying speed and carrying distance, etc. of the device used, but in cases of high-speed carrying of 50 cm/second or greater or carrying for printing on ruled line sheets, it is preferably 70° or less as measured by JIS-A. If the rubber hardness is 40° or less, the abrasiveness of the blend rubber is impaired, sometimes making it unable to withstand long-term use. The rubber hardness may be adjusted as desired by changing the degree of polymerization of the prepolymer and the amounts and types of the curing agents. With a rubber hardness of 40° or greater for solid types, extended use is possible even if the apparent rubber hardness of a rubber roller formed by molding foaming rubber is less than 40°.

A liquid urethane rubber prepolymer and liquid silicone rubber prepolymer may be used to prepare the blend rubber. Urethane rubber prepolymers are generally represented by the following formula

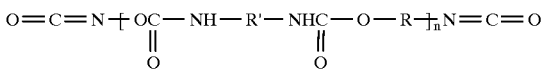

wherein R is a divalent hydrocarbon group, R' is a hydrocarbon group containing an ether bond or ester bond, and n is a positive integer.

Furthermore, urethane rubbers may be classified by the type of the divalent hydrocarbon group (R); those comprising a repeating unit wherein R is an ether bond are known as ether-type urethanes, and those wherein R is an ester bond are known as ester-type urethanes. Also, of the group of ester-type urethanes, those prepared by ring opening polymerization of ε-caprolactone or the like are often known as caprolactone-type urethanes. The liquid urethane rubber prepolymer to be used according to the present invention is preferably one which contains isocyanate (—N═C═O) in an amount of 2–8 wt %.

Also, the silicone rubber prepolymer preferably is one comprising a repeating unit represented by the following formula,

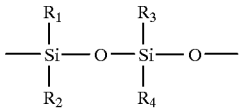

wherein each of $R_1$, $R_2$, $R_3$ and $R_4$ is independently an alkyl group, cycloalkyl group, vinyl group, phenyl group or benzyl group, and having a viscosity of 5 to 5,000 poise as measured at 25° C.

The liquid urethane rubber prepolymer and liquid silicone rubber prepolymer as mentioned above are combined at a prescribed mixing ratio, preferably after being allowed to stand at a constant temperature of 40–80° C. to lower the viscosity, and stirred. Next, the curing agents for the respective prepolymers are added, if necessary, and the mixture is further stirred to uniformity. After deairing at a prescribed temperature, the blend prepolymer is poured into a cast metal mold. The curing agent for the urethane prepolymer may be a conventionally used curing agent, such as a diamine, triamine or other polyvalent amine, a glycol or a trihydroxy compound, and 3,3'-dichloro-4,4'-diaminodiphenylmethane, 1,4-butanediol and triisopropanolamine are suitable for use. Furthermore, the curing agent for the silicone rubber must be selected based on the types of functional groups in the silicone prepolymer. After casting, the mixture is cured at a prescribed temperature for a prescribed period of time, the rubber roller is removed from the metal mold, and if necessary, the contour is ground and polished, to obtain the final product.

The rubber roller according to the present invention may also include an inorganic or organic component other than the rubber components. Such components include, for example, fillers such as carbon, silica fine powder, iron oxide red, etc., DOP (di-2-ethylhexyl phthalate), DHP (diisoheptyl phthalate), plasticizers such as paraffin or aromatic processing oils, lubricants, and the like.

A sketch of an example of an automatic cash dispenser using rubber rollers according to the present invention is shown in FIG. 1. In this figure, 1 is a pick-up roller consisting of a rubber roller of the present invention, and the friction force of its rotation causes receipts 3, over which is placed a load 2, to be moved one by one to a position where the front ends of the receipts engage with a feed roller 4. The feed roller 4 rotates at a higher speed than the pick-up roller, and thus each receipt is moved by the rotating force of the feed roller 4 between it and a friction member 5 while slipping on the surface of the pick-up roller, after which it is ejected from the device via a nip roller 6. The next receipt is held down by a blade 7, and thus is not moved even when the pick-up roller 1 is rotated. When ejection of the first sheet has been completed, the same process is repeated for the next receipt, and in this manner the receipts are successively fed and ejected in order.

A rubber roller abrasion evaluating tester will now be explained with reference to FIG. 2. This tester is characterized by comprising 2 rubber rollers 8 and 9, with rubber roller 8 being the object of the evaluation. The rubber roller 9 is constructed so as to allow either its pressure contact with roller 13 or its non-contact rotation. The rollers 10–15 are freely rotatable metal rollers. The construction may also be such that a sheet of medium to be carried 16 is dispensed from a dispensing roller 17 and wound up by a winding roller 18, or alternatively a circular medium to be carried may be endlessly conveyed in the manner indicated by the dotted line in the drawing. The rubber rollers 8 and 9 are built so as to be driven by separate independent stepping motors (not shown). Also, a mechanism is provided so that a desired load may be applied to the rubber roller 8 which is the object of evaluation, by a pressure setting balancer 19 via the roller 12. This type of mechanism allows momentary evaluation of the dual effects on the rubber by the carrying of the paper and the slippage of the paper. Furthermore, the mechanical pressure placed on the rubber roller 8 by the pressure setting balancer 19 may be set to match that of the actual device. As a result, this evaluating device may be used to reproduce the same action as the automatic cash dispenser mentioned above; i.e., the feeding of the rubber roller 8 corresponds to the feeding of the pick-up roller, the abrasion of the rubber roller 8 caused by carrying of the medium by the rotation of the rubber roller 9 corresponds to the abrasion of the pick-up roller caused by carrying of the receipts by the rotation of the feed roller, and since the same dynamical pressure may be applied as in the actual device, it is possible to accurately evaluate the degree of abrasiveness and change in friction coefficient of the rubber roller in the actual device.

Figure 3:
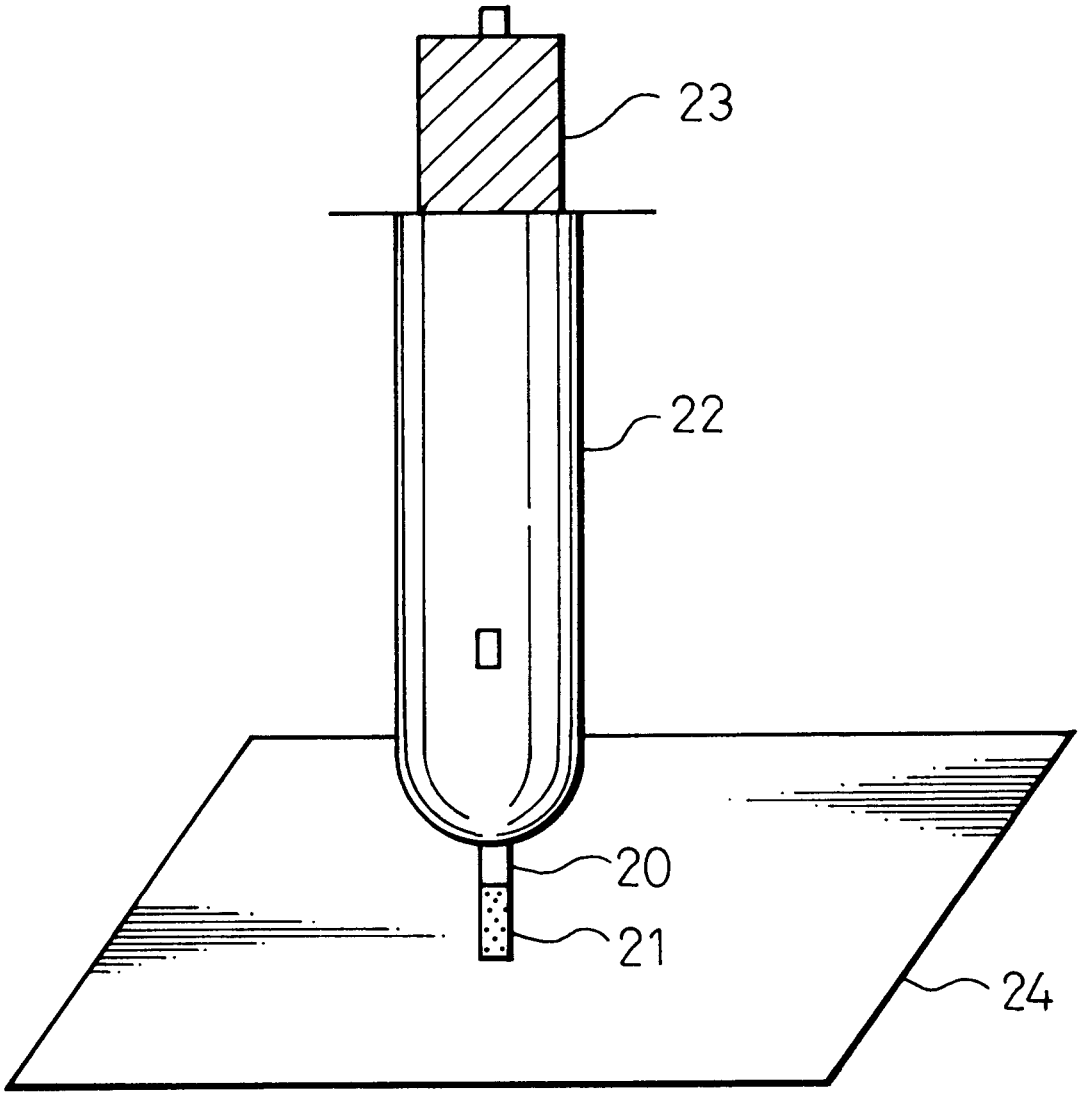
FIG. 3 is a sketch of a device used in the method of selecting media to be carried according to the present invention.

A method of selecting sheets to be carried will now be explained with reference to FIG. 3. A motor 22 is connected to rubber containing a grinding agent 21 which is held by a chuck 20 on the tip thereof. A constant load 23 is applied to the motor to cause the motor to rotate at a constant speed, the time is measured until a hole opens in the carried sheet 24 of the actual device, and the abrasion rate of the paper is calculated based on measurement of the thickness of the paper. In this manner, paper is selected which has the same friction coefficient, in a form which may be set in the rubber roller evaluating tester, while also having the same abrasion rate as paper carried in the actual device. With this method it is possible to use in the rubber roller abrasion evaluating tester sheets which have the same surface condition and strength as the medium carried in the actual device, and therefore the evaluation of the rubber rollers by abrasion testing may accurately reflect the state occurring in the actual device, making it possible to select and develop the optimum rubber rollers for the type of carrying in the actual device.

The present invention will now be explained more fully with reference to the examples.

EXAMPLE 1

A urethane prepolymer/silicone prepolymer blend was prepared with the following composition.

| | |
|---|---|
| Ester-type urethane prepolymer (Cyanapren A-9 QM, product of Takeda Yakuhin, K.K., isocyanate content: approx. 4.2 wt %) | 40 g |
| Urethane curing agent | |
| Triisopropanolamine | 0.94 g |
| 3,3'-dichloro-4,4'-diaminodiphenylmethane | 0.94 g |
| Silicone prepolymer (TSE3450, product of Toshiba Silicone, K.K., viscosity at 25° C.: approx. 1,000 poise) | 10 g |
| Silicone curing agent (TSE3450-B, product of Toshiba Silicone, K.K.) | 1.0 g |

The urethane prepolymer and silicone prepolymer were melted in a constant temperature bath at 60° C. Next, after mixing the prescribed amounts of each, vacuum deairing was performed for 5 minutes. The obtained polymer blend was then poured into a cast iron mold at 70° C. Heating was performed at 100° C. for 10 minutes to prepare a crosslinked rubber roller. The shape of this rubber roller was a 30 mmϕ×10 mm cylinder with a 15 mmϕ×20 mm core at the center, and the rubber hardness was 60° according to JIS-A.

EXAMPLE 2

A urethane prepolymer/silicone prepolymer blend was prepared with the following composition.

| | |
|---|---|
| Ether-type urethane prepolymer (Coronate C-4080, product of Nihon Polyurethane, K.K., isocyanate content: approx. 2.8 wt %) | 40 g |
| Urethane curing agent (Nippolan 4038, product of Nihon Polyurethane, K.K., glycol-type curing agent) | 1.1 g |
| Silicone prepolymer (TSE3450, product of Toshiba Silicone, K.K.) | 10 g |
| Silicone curing agent (TSE3450-B, product of Toshiba Silicone, K.K.) | 1.0 g |

A rubber roller was prepared in the same manner as in Example 1. The rubber hardness of the rubber roller was 62° according to JIS-A.

EXAMPLE 3

A urethane prepolymer/silicone prepolymer blend was prepared with the following composition.

| | |
|---|---|
| Ether-type urethane prepolymer (Sanprene P-664, product of Sanyo Kasei, K.K., isocyanate content: approx. 4,2 wt %) | 40 g |
| Urethane curing agent (triisopropanolamine) | 2.44 g |
| Silicone prepolymer (YE5626, product of Toshiba Silicone, K.K., viscosity at 25° C.: approx. 600 poise) | 10 g |
| Silicone curing agent (YE5626-B, product of Toshiba Silicone, K.K.) | 1.0 g |

The same procedure as in Example 1 was followed, except that the melting, stirring and vacuum deairing was carried out at 50° C. The rubber hardness of the resulting rubber roller was 58° according to JIS-A.

EXAMPLE 4

A urethane prepolymer/silicone prepolymer blend was prepared with the following composition.

| | |
|---|---|
| Ether-type urethane prepolymer (Sanprene P-664, product of Sanyo Kasei, K.K.) | 20 g |
| Urethane curing agent | |
| Triisopropanolamine | 0.96 g |
| 3,3'-dichloro-4,4'-diaminodiphenylmethane | 0.5 g |
| Silicone prepolymer (TSE3450, product of Toshiba Silicone, K.K.) | 20 g |
| Silicone curing agent (TSE3450-B, product of Toshiba Silicone, K.K.) | 2.0 g |

The same procedure as in Example 1 was followed, except that the melting, stirring and vacuum deairing was carried out at 50° C. The rubber hardness of the resulting rubber roller was 58° according to JIS-A.

EXAMPLE 5

A urethane prepolymer/silicone prepolymer blend was prepared with the following composition.

| | |
|---|---|
| Ether-type urethane prepolymer (Sanprene P-664, product of Sanyo Kasei, K.K.) | 40 g |
| Urethane curing agent (triisopropanolamine) | 2.44 g |
| Silicone prepolymer (TSE3250, product of Toshiba Silicone, K.K., viscosity at 25° C.: approx. 13 poise) | 10 g |

The same procedure as in Example 1 was followed, except that the melting, stirring and vacuum deairing was carried out at 60° C. The rubber hardness of the resulting rubber roller was 53° according to JIS-A.

EXAMPLE 6

A urethane prepolymer/silicone prepolymer blend was prepared with the following composition.

| | |
|---|---|
| Caprolactone-type urethane prepolymer (Takenate L-5060, product of Takeda Yakuhin, K.K., isocyanate content: approx. 6.2 wt %) | 40 g |
| Urethane curing agent (Takelac U-7011, product of Takeda Yakuhin, K.K.) | 9.0 g |
| Silicone prepolymer (TSE3250, product of Toshiba Silicone, K.K.) | 10 g |
| Liquid paraffin | 3.0 g |
| Silica fine powder (Aerogil #200, product of Nihon Aerogil, K.K.) | 3.0 g |

The same procedure as in Example 1 was followed, except that the melting, stirring and vacuum deairing was carried out at 70° C. The rubber hardness of the resulting rubber roller was 52° according to JIS-A.

Evaluation example 1

Figure 2:
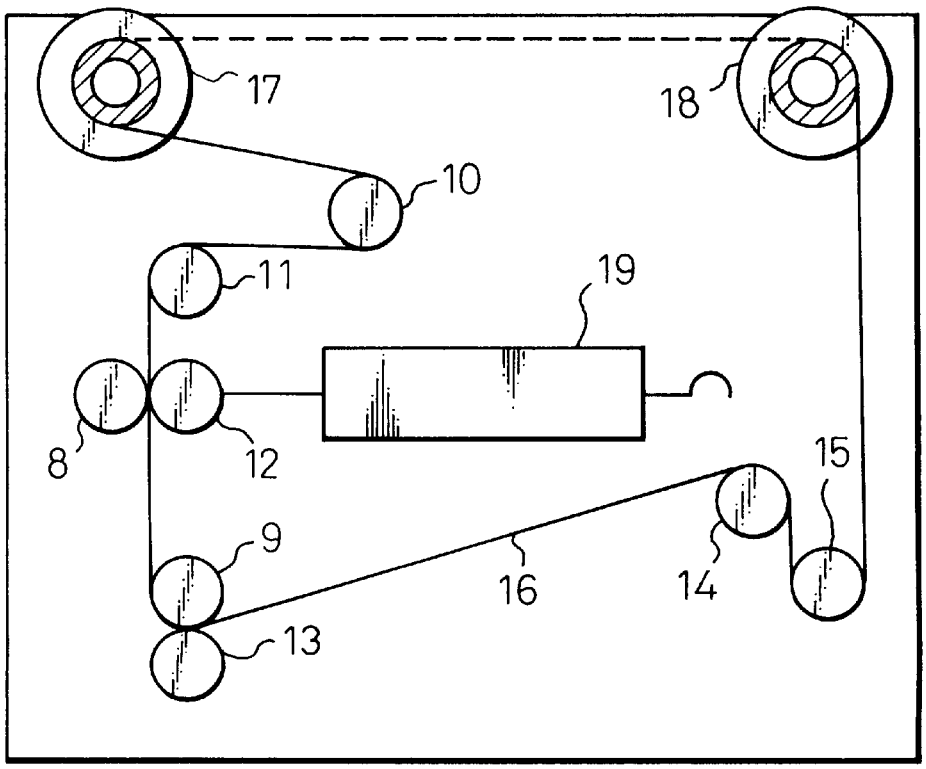
FIG. 2 is a sketch of an abrasion evaluating tester according to the present invention.

The rubber roller prepared in Example 1 was installed in an abrasion evaluating tester according to the present invention having the construction shown in FIG. 2. First, 17.5 mm of the paper medium 16 was fed by one rotation of the rubber roller 8 with the rubber roller 9 at rest, and then 36.7 mm was fed by one rotation of the rubber roller 9 with the rubber roller 8 at rest. The conveying speed was 25.0 cm/second. The belt-like paper medium 16 was in an annular form for endless conveying. The abrasiveness was evaluated by measuring the decrease in weight of the rubber roller 8. The friction coefficient was measured using a HEIDON-14D surface measuring instrument (product of Shinto Kagaku, K.K.), with a stage movement speed of 6000 mm/min and a press weight of 500 gw. Also, the abrading paper used for measurement of the friction coefficient was a Bank of Japan 1,000 yen bill (newly printed). Here, one rotation of the rubber roller 8 and the subsequent one rotation of the rubber roller 9 was defined as one cycle.

The initial values were taken as the physical values of the rubber roller after carrying 1000 cycles. The degrees of abrasion and friction coefficients after each cycle were as listed in the following table. Even after 150,000 cycles, it was found that the rubber roller of Example 1 had a low degree of abrasion and little change in the friction coefficient, with a better balance between low abrasiveness and low change in friction coefficient, as compared to urethane rubber, silicone rubber, natural rubber, butadiene rubber, ethylene/propylene/diene tertiary rubber, and the like.

| Abrasion test | | | |
|---|---|---|---|
| | Initial value | After 150,000 cycles | |
| | Friction coefficient (–) | Abrasion rate (%) | Friction coefficient (–) |
| Rubber of Example 1 | 1.1 | 0.2 | 1.0 |
| Urethane rubber (58°)* | 1.2 | 0.1 | 0.8 |
| Silicone rubber (55°)* | 1.2 | 0.6 | 1.2 |
| Natural rubber/ butadiene rubber (55°)* | 1.2 | 1.2 | 1.2 |

*Rubber hardness according to JIS-A

The rubber rollers were also tested for ink adhesion. An ink ribbon was affixed onto the moving stage, after which a 25 g weight was placed on a rubber roller anchored to prevent its rotation, in order to contact it with the ink ribbon, and the moving stage was engaged in reciprocating motion. The friction coefficient was measured when ink adhered to the surface of the rubber roller in this manner. Ten thousand cycles of the reciprocating motion were continued for each 10 cm of ink ribbon. The changes in the friction coefficients were as listed in the following table, and it was shown that the rubber roller of Example 1 exhibited no lowering in the friction coefficient even with adhesion of ink.

| Slippage test | | |
|---|---|---|
| | Initial | After 10,000 slips |
| Rubber of Example 1 | 1.1 | 1.1 |
| Urethane rubber | 1.2 | 0.8 |
| Silicone rubber | 1.2 | 1.2 |
| Natural rubber/butadiene rubber | 1.2 | 1.2 |

As a result of the above-mentioned abrasion evaluating test and ink adhesion test, it became clear that the sample of Example 1 is capable of withstanding extended use as a rubber roller for carrying paper.

Evaluation example 2

The same tests as in Evaluation example 1 were performed for the rubber rollers of Examples 2 to 6. However, a Bank of Japan 1,000 yen bill was used as the object of the ink adhesive test, instead of the ink ribbon used in Evaluation example 1. The results are listed in the following table.

| Evaluation of dynamic tester | | | |
|---|---|---|---|
| | Initial value | After 150,000 cycles | |
| | Friction coefficient (–) | Abrasion rate (%) | Friction coefficient (–) |
| Example 2 | 1.1 | 0.2 | 1.1 |
| Example 3 | 1.1 | 0.1 | 1.0 |
| Example 4 | 1.2 | 0.3 | 1.2 |
| Example 5 | 1.2 | 0.2 | 1.1 |
| Example 6 | 1.1 | 0.0 | 1.1 |

-continued

| Evaluation of slippage test | | |
|---|---|---|
| | Initial | After 10,000 slips |
| Example 2 | 1.1 | 1.1 |
| Example 3 | 1.1 | 1.1 |
| Example 4 | 1.2 | 1.2 |
| Example 5 | 1.2 | 1.2 |
| Example 6 | 1.1 | 1.1 |

According to the present invention, there are provided rubber rollers which undergo no abrasion and little lowering of the friction coefficients even over long periods of time, whether printing on normal recording sheets or ruled lined paper, or when carrying sheets which undergo various types of processing such as receipts and train tickets, and thus the necessity of replacing the rubber rollers is eliminated for a longer period of time. As a result, use of the rubber rollers of the present invention provides excellent carrying properties, including high speed conveying with a small load, and carrying by a constant distance with constant rotation due to the absence of slippage between the carried medium and the rubber rollers.

Also, the abrasion evaluating tester according to the present invention makes it possible to evaluate the progression of abrasion without using an apparatus actually equipped with the rollers, and therefore the life of the rubber rollers may be evaluated in a shorter period of time.

Further, the method of selecting media to be carried according to the present invention in the abrasion evaluating tester of the present invention allows paper to be selected and evaluated which has abrasion characteristics close to those of the actual medium to be carried, even when the actual medium to be carried cannot be used, thus facilitating the evaluation of the actual abrasion characteristics.

We claim:

1. A rubber roller for carrying media, which comprises a blend of 30–95 wt % urethane rubber and 5–70 wt % silicone rubber, said blend prepared by mixing a liquid urethane rubber prepolymer and a liquid silicone rubber prepolymer and curing the mixture, and having a rubber hardness in the range of 40° to 70° according to JIS-A.

2. An apparatus equipped with means for carrying media which includes a rubber roller comprising a blend of 30–95 wt % urethane rubber and 5–70 wt % silicone rubber, said blend prepared by mixing a liquid urethane rubber prepolymer and a liquid silicone rubber prepolymer and curing the mixture, and having a rubber hardness in the range of 40° to 70° according to JIS-A.

3. An apparatus according to claim 2 which is an information-related device.

4. An apparatus according to claim 2 which is an automatic cash dispenser or automatic ticket dispenser.

5. An apparatus according to claim 2 which is an automatic ticket gate machine.

* * * * *